United States Patent [19]

Taylor

[11] Patent Number: 4,745,720

[45] Date of Patent: May 24, 1988

[54] INSULATED CINDERBLOCK

[76] Inventor: Lawrence H. Taylor, P.O. Box 210.577, Dutch Fork PO Branch, Columbia, S.C. 29221

[21] Appl. No.: 29,547

[22] Filed: Mar. 24, 1987

[51] Int. Cl.[4] ..... E04C 1/16

[52] U.S. Cl. ..... 52/405; 52/442; 52/563

[58] Field of Search ..... 52/405, 426, 562, 563, 52/564, 404, 565, 442, 589

[56] References Cited

U.S. PATENT DOCUMENTS

| | | | |
|---|---|---|---|
| 1,962,906 | 6/1934 | Mueller | 52/564 |
| 2,194,047 | 3/1940 | Markle | 52/405 |
| 2,212,184 | 8/1940 | Powell | 52/589 |
| 2,252,155 | 8/1941 | Baldwin | 52/562 |
| 4,263,765 | 4/1981 | Maloney | 52/405 |
| 4,619,098 | 10/1986 | Taylor | 52/481 |

FOREIGN PATENT DOCUMENTS

| | | | |
|---|---|---|---|
| 640752 | 5/1962 | Canada | 52/426 |
| 1075695 | 10/1954 | France | 52/563 |

*Primary Examiner*—John E Murtagh

*Attorney, Agent, or Firm*—Kerkam, Stowell, Kondracki & Clarke

[57] ABSTRACT

A structural cinderblock which has been split into two pieces which are held together by special initial channels which limit heat transmission; with insulating material centered in the block cavities and laid over grating to prevent heat loss due to convection.

4 Claims, 2 Drawing Sheets

FIG. 1
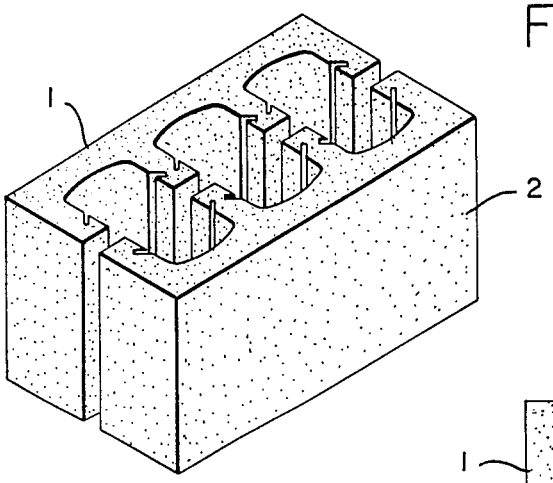
FIG. 2
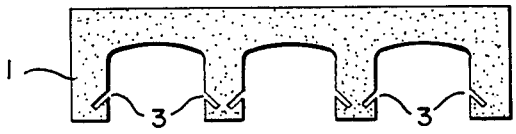
FIG. 3a
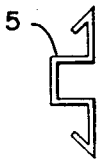
FIG. 3b
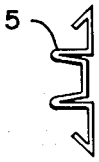
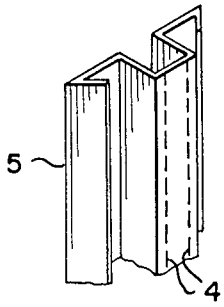
FIG. 4
FIG. 5
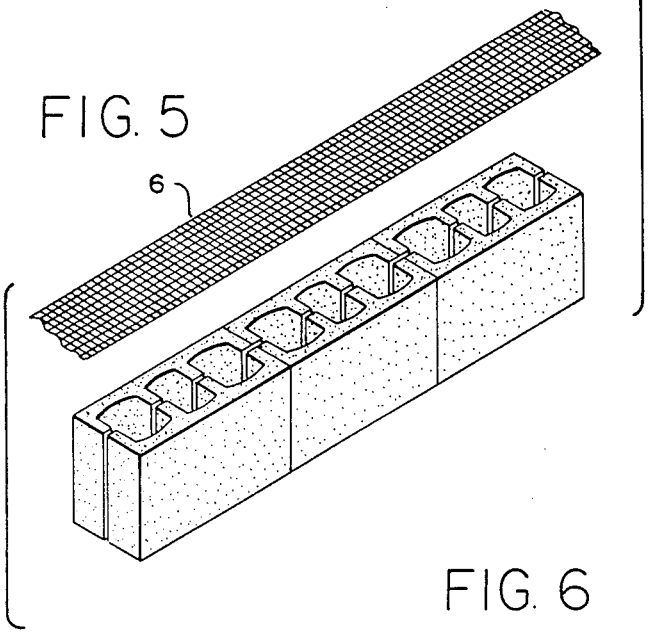
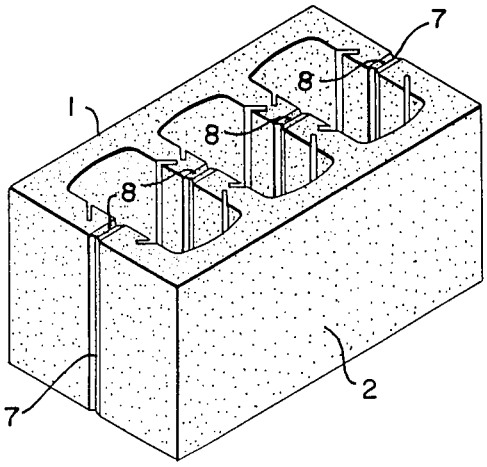
FIG. 6

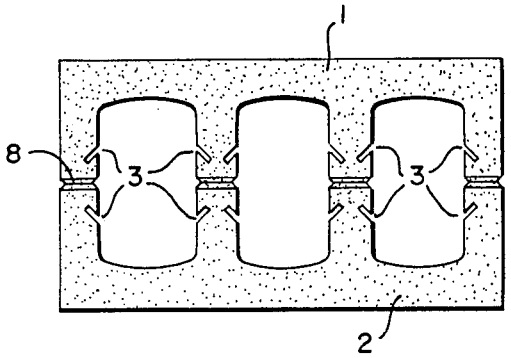
FIG. 7
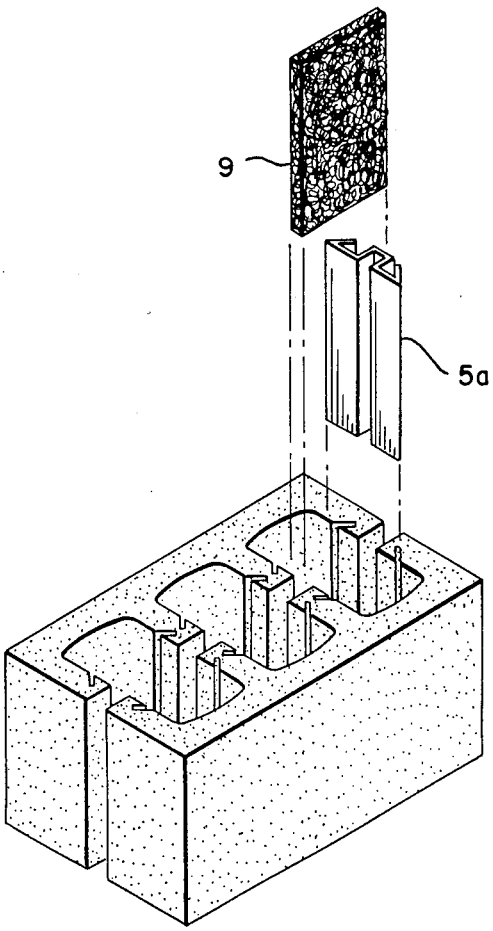
FIG. 8
FIG. 9
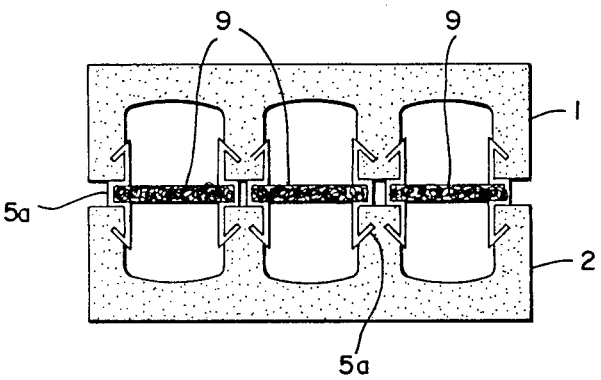
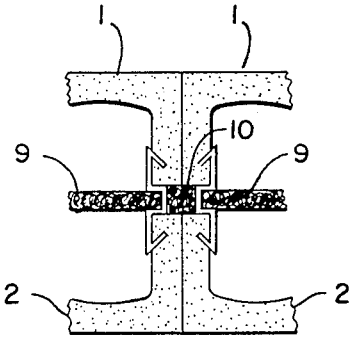
FIG. 10

INSULATED CINDERBLOCK

BACKGROUND OF THE INVENTION

For many decades, it has been of growing importance to mankind to conserve energy, especially in cooling and in heating, with the rate of such conservation need thru insulation being exacerbated by the comparatively recent Arab generated oil crisis.

For even more decades the building trade, particularly for low rise buildings, has used a relatively standard form of two or three cavity cinderblock measuring usually, with some exceptions, 8"×8"×16", that in this form, is a practical size, lightweight block of sufficient width to provide a single course wall of reasonable lateral stability and weight bearing capability, but lacking in any stand alone effective insulation capability.

It was obvious, even in the days prior to the energy "crunch", that there was a clear, but not yet urgent need for the cinderblock of the day to be in some way improved in its insulation capability to thus avoid the costly, but necessary, practice of using special and expensive insulation sheets under the exterior sheathing for the outside, and then often on the inside of the wall, as well.

The conventional cinderblock, having been tested and accepted in the many millions for its structural strength, low cost, and simplicity of erection, even by less skilled labor, it was obvious that the optimum solution would be preferably, if possible, to improve upon the structure of the existing standard cinderblock itself, with its ready market acceptance, rather than attempting to generate an entirely new type of block system for walls, or new all systems of different materials.

In any insulation system used for building walls, depending upon the season, one side, in or out, becomes the collector panel for heat, and the opposite side serves the reverse purpose of dispensing heat. If the block remains one integral unit, however, little can be done because of the solid internal cross members between outer faces to effectively limit the blocks heat transmission capability, unless the block is split into two separated face pieces, to create two separate heat zones. With the block therefore being separated into two different heat zones, to serve this purpose, the passage of heat between the two separate, but structurally related halves, must be restricted in every feasible manner, which inalienable, but evident physical principle is the basis of a classic dilemma in this art, i.e., that the structural mechanism holding both halves together, so that the block retains its customary structural strength, must be of considerable physical strength, implying the use of metal, yet conversely, the more metal used to restore strength to the split-in-half block, the more heat that this metal connecting system will conduct, unless it is of very unique and special design such as this disclosure presents.

A structural analysis further documents the controlling fact that the stronger the split block is to be made, the more metal is required to make it so, at the obvious expense, i.e., loss of R value, or restated, the weaker the block, the higher the R value, with neither extreme being an acceptable answer to the building trades with the median structural design also being a poor solution in offering at best, a poorly insulated and also structurally weak block, obviously, not of serious market interest, in view of the fact that this ineffective compromise has not yet found favor or market participation of any sort over many years in those commercial markets, usually, but not always, so quick to employ truly beneficial technology in their conduct of business, if such technology is available, which it has not been until present day.

The most likely reference patent in the prior art, Powell has well illustrated the existence of this dilemma in which various innovators have sought to satisfy the obvious need with ineffective solutions, being unable to provide the needed physical strength without the loss of too much insulation factor by simply splitting the cinderblock. Powell's solution, obviously, was to use less metal connector material in order to limit heat conduction between the inner and outer block faces to just two of a possible four connectors, and then to use very slender spring metal clips at just the top and bottom on each of the end internal block face connectors so that the minimum amount of heat conductive metal is therefore used at, however, serious, expense of the essential physical block strength needed, thus, Powell is, in effect, when building a wall, creating two separate but contiguous half walls made of thin half cinderblocks barely held together by a limited number of thin lightweight non-structural, spring metal clips that cannot provide lateral stability.

The novel, and far from obvious solution to this dilemma, lies in the use of a technique already patented under U.S. Pat. Nos. 4,619,098 and 4,638,615 which discloses a method under which a metal web, such as the center part of the channel described below, is slit along the lines of said patent disclosure to very materially reduce heat transmission through a structural sheet metal member, without material loss of strength for the applications to which it is put.

What is therefore disclosed herein, is a full length channel structure holding together the respective halves of a cinderblock at all possible points, so that the reconstituted block may function structurally with all required strength, and yet achieve the most desirable results of having each half of the reconstituted block being substantially separate from the other half in terms of heat content, because the unique and novel structural means uniting the separate half pieces is made in such a way as to very substantially limit heat transmission by the essential and structurally strong, but insulative means, holding the half pieces together, so that united they will function as a single insulated block.

Once the half blocks are held firmly together to make one reconstituted block by structurally strong insulative means, it is then necessary only to limit convection driven means of heat exchange between the respective half blocks joined by the sturdy full length metal channel used on all four interface structural cross members of a three cavity block as shown, for example, obviously other block forms may also employ this disclosed method of block design.

Preferably, the cavity spaces in a three cavity standard block are divided into two separate, but similar cavities by the insertion of a vertical insulative divider placed at the center of the block, parallel in plane to the exterior faces of the block and equidistant from the inner and outer faces as shown with the sides of said divider extending into the positioning slot created by the vertical center web of the channel fastening member holding the block halves together and apart. This divider may be made of many materials, but at this stage of the art it is to be made preferentially out of a closed bubble solid phenolic foam bat of at least one inch in thickness and wide enough to fit snugly in between the cavity side walls and project into the spaces between the block halves provided by the connecting channel member firmly holding the half block components both apart, and together as shown. If bats thicker than the space provided by the channel members are to be used, the sides of the bats must be suitably contoured to fit in the grooves. Increased bat thickness will not provide proportionately increased "R" values.

It is obvious that if an effectively insulated, but strong, wall structure is to be built, the blocks must be offset, as they are customarily for brick, and other block wall construction by one-half block spacing, right or left, from one layer or course, to the next layer above. Building thus, with the cavities in each cinderblock lying above one another, it is necessary to block the resulting vertical air passages that will allow convection currents of air to move freely up and down, as well as laterally from exterior cavity patterns to interior cavity patterns to some extent in diagonal paths, as required by temperature changes, and thus adversely affect the insulating capability of the wall structure as a whole.

The vertical air passages exterior to exterior, interior to interior, and between exterior and interior are, therefore, sealed off as each course of blocks is laid, by laying a long metal screen piece on top of grouted blocks as they are laid. The medium density screen piece when laid is thinly grouted over to seal the screen mesh against vertical air passage and also to give more grout to bind to the bottom surface of the next blocks above as they are laid. As the mesh is relatively open, but tight enough, like hardware cloth, to support grout or mortar, over the cavity areas, the mortar above and below the mesh unites into a homogenous blend and thus functions in every way as well as a conventional mortar layer binding blocks in place, except that the metal mesh further acts strongly to reinforce the wall and the mortar under certain types of stress that might otherwise seriously strain the wall structure and the connective channels holding the half blocks together to form single structurally strong, but well insulated blocks, out of which low cost, structurally sound, weight bearing walls, with high R value can be built.

The manufacture of the components used in making the block takes advantage of the latest factory procedural skills to hold costs to a minimum. The blocks are made in vertically loaded molds which make all the necessary vertical retaining grooves and, as well, the required split lines of indentation for splitting the blocks once cured. Due to the fact that one inch is taken out of the width of the standard 8"×8"×16" block for the channel spacer, these blocks are made 8"×7"×16" before splitting to be reconstituted as 8"×8"×16" blocks of standard size.

The channel components are slit on a coil slitter when cut from the master coil and then roll formed in production on a standard roll former to the desired configuration in cross section.

In production, the two half blocks are joined into one, as the metal channels are pressed down into place. The insulation bats are then pressed down into the spaces provided for them by the channels, and the insulated block is then ready for use.

BRIEF DESCRIPTION OF THE DRAWINGS

FIG. 1 shows a conventional three cavity block, split and separated, ready for the installation of channel components;

FIG. 2 shows a plan view of a half block;

FIGS. 3*a* and 3*b* show end or plan views of the channel components;

FIG. 4 shows a perspective of channel with insulating slits;

FIG. 5 shows several blocks with a piece of metal mesh above it, prior to being put on top of the blocks;

FIG. 6 shows a block with split indentations prior to being split;

FIG. 7 shows a plan view of FIG. 6;

FIG. 8 shows the installation of a channel connector and an insulation bat shown above, prior to downward insertion;

FIG. 9 shows a channel connector and an insulation bat in place, plan view;

FIG. 10 shows optional use of a narrow insulation bat between block ends.

COMPONENT NUMBERS

1 & 2. Opposite half blocks

3. Vertical slots

4. Vertical slit lines of insulation

5. Structural channel, 5A version with no fold back, 5B with foldback

6. Wire mesh

7. Indentation groove in end of block to facilitate splitting block

8. Indentation groove in top of block for splitting purpose

9. Insulation bat

10. Optional insulation bat

The manufacture of the insulated block itself is quite simple as the 8"×7"×16" cast piece with grooves for best splitting, is split in half, spaced apart, and rejoined by means of downwardly applied channel spacer fasteners of the same height as the block being used on all four abutting cross member wall ends with four channels being used, as shown on a three cavity block. On completion of the block assembly, three center cavity insulation bats, on a three cavity block, are pressed down into the open side grooves to divide each single cavity into two cavities separated by the insulated bat of the same height as the block. If the block is to be varied in the number of cavities or dimension, the number and shape of components must be varied to fit.

I claim:

1. A cinderblock having parallel interior and exterior faces with a cavity space between the faces so structured as to retain its conventional shape and basic structural strength, but simultaneously to provide a much higher level of insulative effectiveness through its physical construction, said cinderblock including disparate front and back half portions of a block vertically split on a longitudinal plane parallel to the block exterior face of the block held both rigidly apart, and together in a fixed relationship by a multiplicity of vertical metal channels between the opposing halves of the assembled block, a vertical full height panel of non-porous semi-rigid insulating material placed within the cavity space dividing the cavity space, into two separate dead air spaces to abut the front and back block sections respectively, with said vertical metal channel connecting elements being provided with a multiplicity of vertical lines of slits of not more than 15,000 ths of an inch to, provide a discontinuity for purpose of restructuring heat flow through the center portion of the vertical structural channel.

2. A cinderblock as defined in claim 1 including a sheet of sealing material buttered with mortar laid horizontally over the cinderblock to thus prevent vertical vertical air convection between the respective dead air cavity.

3. A cinderblock as defined in claim 1 in which the vertical slits do not compose linerally more than 80% or less than 50% of the length of the line slits.

4. A cinderblock as defined in claim 1 including a further insulation bat at the end of each block to form an insulative connector between an adjacent cinderblock.

* * * * *